US008348533B2

(12) United States Patent
Miyashita

(10) Patent No.: US 8,348,533 B2
(45) Date of Patent: Jan. 8, 2013

(54) PRINTER

(75) Inventor: Shinichi Miyashita, Yamanashi (JP)

(73) Assignee: Citizen Systems Japan Co., Ltd., Tokyo (JP)

( * ) Notice: Subject to any disclaimer, the term of this patent is extended or adjusted under 35 U.S.C. 154(b) by 308 days.

(21) Appl. No.: 12/810,206

(22) PCT Filed: Dec. 15, 2008

(86) PCT No.: PCT/JP2008/072766

§ 371 (c)(1),
(2), (4) Date: Jun. 23, 2010

(87) PCT Pub. No.: WO2009/084415

PCT Pub. Date: Jul. 9, 2009

(65) Prior Publication Data

US 2011/0142521 A1 Jun. 16, 2011

(30) Foreign Application Priority Data

Dec. 28, 2007 (JP) ..... 2007-340505

(51) Int. Cl.
*B41J 11/00* (2006.01)
*B41J 11/04* (2006.01)
*B41J 11/14* (2006.01)
*B41J 19/00* (2006.01)

(52) U.S. Cl. ..... 400/659; 400/569; 400/648; 400/649; 400/660

(58) Field of Classification Search ..... 400/569, 400/648, 649, 659, 660, 660.2, 660.3; *B41J 11/04, B41J 11/14, 23/02*

See application file for complete search history.

(56) References Cited

U.S. PATENT DOCUMENTS

| | | | | |
|---|---|---|---|---|
| 6,412,995 | B2 * | 7/2002 | Togashi et al. | 400/649 |
| 6,666,604 | B1 * | 12/2003 | Montagutelli | 400/649 |
| 7,165,903 | B2 * | 1/2007 | Naito | 400/660 |
| 2002/0021927 | A1 * | 2/2002 | Mori et al. | 400/120.01 |
| 2003/0103793 | A1 * | 6/2003 | Murakoshi et al. | 400/621 |

FOREIGN PATENT DOCUMENTS

JP 5-185668 A 7/1993

(Continued)

OTHER PUBLICATIONS

International Search Report for PCT/JP2008/072766, mailing date of Mar. 17, 2009.

*Primary Examiner* — Judy Nguyen
*Assistant Examiner* — Marissa Ferguson Samreth
(74) *Attorney, Agent, or Firm* — Westerman, Hattori, Daniels & Adrian, LLP

(57) ABSTRACT

There is provide a printer having a rotational driving mechanism in which a print sheet can be fed in both of forward and reverse directions and a platen can be securely supported without dropping off from a head holder. The printer contains a head unit 4, a platen 20 that is freely rotatably mounted on the head unit 4 to support a print sheet and feed a print sheet through rotation, and a print head 53 for performing print on the print sheet supported by the platen 20. The head unit 4 has support grooves 10 for supporting the rotational shaft 21 of the platen 20, and a rotational driving mechanism 30 having plural gears for transmitting the rotational driving force of a driving motor 40 to a platen-side gear 22. The rotational driving mechanism 30 contains a gear 33 at the end side and two planetary gears 36 and 37. When the print sheet is fed in the forward direction, the first planetary gear 36 is engaged with the platen-side gear 22 to transmit the rotational driving force, and also when the print sheet is fed in the reverse direction, the second planetary gear 37 is engaged with the platen-side gear 22 to transmit the rotational force.

4 Claims, 10 Drawing Sheets

FOREIGN PATENT DOCUMENTS

| | | | |
|---|---|---|---|
| JP | 05-330160 | * | 12/1993 |
| JP | 2001-232874 | A | 8/2001 |
| JP | 2002-326405 | * | 11/2002 |
| JP | 2002-370411 | A | 12/2002 |
| JP | 2003-246103 | A | 9/2003 |
| JP | 2003-300351 | A | 10/2003 |

* cited by examiner

PRINTER

BACKGROUND OF THE INVENTION

1. Technical Field

The present invention relates to a printer having a platen that is freely detachably mounted in a printer frame, and particularly to a printer in which a platen installed in a cover is detachably mounted in a printer frame in connection with opening/closing of the cover in a drop-in type printer in which a cover is freely openable/closable with respect to the printer main body.

2. Background Art

A printer disclosed in Patent Document 1 which has been proposed by the applicant of this application is known as this type of printer. According to the printer disclosed in the Patent Document 1, a platen held in a platen holder is configured to be freely detachably mounted in a frame for holding a print head. As shown in FIG. 11 of the Patent Document 1, the platen holder is installed in a platen unit arm (corresponding to a cover), and the frame is installed in a platen unit base (corresponding to a printer main body).

A support groove in/from which the rotational shaft of the platen is inserted/detached in connection with attachment/detachment of the platen is formed in the frame. A platen-side gear is secured to one end of the rotational shaft of the platen, and a driving motor and a rotational driving mechanism are installed in the frame so that the rotational driving force of the driving motor is transmitted to the platen-side gear through the rotational driving mechanism.

The rotational driving mechanism is constructed by a gear train with which the rotational driving force is transmitted through the engagement of plural gears, and one gear located at the most downstream side (hereinafter referred to as a driving-side engaging gear) is engaged with the platen-side gear.

Patent Document 1: JP-A-2003-246103

DISCLOSURE OF THE INVENTION

Problem to be Solved by the Invention

As not clearly described in the Patent Document 1, in a conventional manufactured printer having the same construction, when a print sheet is fed in a forward direction (that is, a sheet is discharged), the rotational driving force transmitted from the driving-side engaging gear to the platen-side gear acts so as to push the rotational shaft of the platen into a bottom portion of the support groove formed in the frame. Accordingly, the rotational shaft is held so as not to be uplifted from the support groove, and the platen can be stably rotated.

However, when the driving motor is reversely driven to rotate the driving-side engaging gear in the reverse direction, the rotational driving force transmitted from the driving-side engaging gear to the platen-side gear acts in a direction which is opposite to the direction given above by 180°, that is, acts in a direction so as to push out the rotational shaft of the platen from the support groove formed in the frame. Accordingly, in this case, the rotational shaft of the platen is uplifted from the bottom portion of the support groove, so that the engagement between the driving-side engaging gear and the platen-side gear is released and thus idling occurs. Furthermore, a gap occurs between a print sheet and the platen, and thus there is a risk that the print sheet cannot be accurately fed.

When only a function of feeding a print sheet in the forward direction is assumed, the conventional construction described above has no problem. However, when the platen is rotated in both the forward and reverse directions to perform a printing operation with various variations, the foregoing problem occurring when the platen is reversely rotated may be an obstacle.

The present invention has been implemented in view of the foregoing situation, and has an object to provide a printer in which the rotational driving force can be securely transmitted to the platen side without the rotational shaft of the platen being uplifted from the support groove when the platen is rotated in both the forward and reverse directions, and also the platen can surely support and feed a print sheet.

Means of Solving the Problem

In order to attain the above object, according to the present invention, a printer having a print head, a platen having one end to which a platen-side gear is secured, a driving motor, a rotational driving mechanism for transmitting the rotational driving force of the driving motor to the platen-side gear, and a printer frame having a support groove having an opening through which the platen is inserted/detached is characterized in that the rotational driving mechanism contains a sun gear, and a pair of planetary gears that move around the sun gear while engaged with the sun gear and are engaged with a platen-side gear, when one of the planetary gears is engaged with the platen-side gear, the planetary gear concerned is engaged with the platen-side gear so as to prevent movement of the platen to the opening of the support groove, and when the other planetary gear is engaged with the platen-side gear, the rotational driving force transmitted to the platen-side gear is prevented from directing to the opening of the support groove.

The printer is configured so that the different planetary gears are engaged with the platen-side gear when a print sheet is fed in forward and reverse directions, respectively. Therefore, the engagement position between each planetary gear and the platen-side gear can be changed in accordance with the rotational force of the platen.

According to the present invention, when one of the planetary gears is engaged with the platen-side gear, the planetary gear concerned is engaged so as to prevent the movement of the platen to the opening of the support groove, and when the other planetary gear is engaged with the platen-side gear, the rotational driving force transmitted to the platen-side gear is prevented from directing to the opening of the support gear. Therefore, even when the platen is rotated in any one of the forward and reverse directions, the platen can be stably rotated and a print sheet can be securely supported by the platen with preventing the rotational shaft of the platen from being uplifted from the support groove.

Furthermore, the present invention may be configured so that the engagement between the platen-side gear and each of the paired planetary gears is released when the platen is inserted/detached. According to this configuration, the rotational shaft of the platen can be easily pulled out from the support groove.

Here, if the pair of plane gears are constructed by gears having the same number of gear teeth, the speed ratio is fixed even when the platen is rotated in any direction of the forward and reverse directions.

The construction that the planetary gear is used as a gear for transmitting the rotational driving force to the platen is disclosed in Patent Document 2. However, the planetary gears (first and second decelerating gears 8, 9) of the Patent Document 2 are used to switch the rotational speed of a platen roller to a low speed or a high speed when a print sheet is fed and ejected, and it has neither disclosure concerning switching of the rotation of the platen between the forward rotation and the reverse rotation and the function of preventing the rotational shaft of the platen from being uplifted from the support groove irrespective of the rotational direction of the platen, nor description concerning the suggestion thereof. Furthermore, it has no disclosure in the first place concerning the construction that the platen is freely detachably mounted in the printer frame in the printer of the Patent Document 2, which should be a precondition for providing the advantageous effect of the present invention.

Patent Document 2: JP-A-2002-370411

Effect of the Invention

As described above, according to the present invention, even when the platen is rotated in any direction of the forward and reverse directions, the stable rotation of the platen and the sure support of the print sheet by the platen can be implemented without the rotational shaft of the platen being uplifted from the support groove.

BRIEF DESCRIPTION OF THE DRAWINGS

FIG. 4 is a diagram showing a main part of the printer according to the embodiment, wherein

FIG. 5 is a diagram showing the construction of a platen of the printer according to the embodiment, wherein

FIG. 7 is a diagram showing a driving motor and a rotational driving mechanism of the printer according to the embodiment, wherein

FIG. 8 is a diagram showing the operation of the rotational driving mechanism when a print sheet is fed in a forward direction in the printer according to the embodiment, wherein

FIG. 9 is a diagram showing the operation of the rotational driving mechanism when a print sheet is fed in a reverse direction in the printer according to the embodiment, wherein

FIG. 10 is an enlarged side view showing another action of a planetary gear in the printer according to the embodiment, wherein

DESCRIPTION OF REFERENCE NUMERALS

1: printer main body, 2: cover, 3: platen/print head unit, 4: head unit, 5: platen unit, 10: support groove, 11: printer frame, 12: sheet guide member, 13: platen mount portion, 14: head operating lever, 20: platen, 21: rotational shaft, 22: platen-side gear, 23: elastic member, 24: bearing, 25: platen holder, 26: opening portion, 30: rotational driving mechanism, 31, 32, 33: gear, 35: switching plate, 36: first planetary gear, 37: second planetary gear, 40: driving motor, 50: head holder, 51: urging member, 52: head support plate, 53: print head, 60: sheet sensor, 61: sensor unit

BEST MODE FOR CARRYING OUT THE INVENTION

An embodiment according to the present invention will be described hereunder with reference to the accompanying drawings.

FIGS. 1 to 10 are diagrams showing a printer according to an embodiment.

In this embodiment, the present invention is applied to a thermosensitive type thermal printer in which a linear print head is disposed in a sheet-width direction. Furthermore, in this embodiment, the present invention is applied to a paper drop-in type printer in which a cover is freely openable/closable with respect to a printer main body as shown in FIG. 1.

Figure 1:
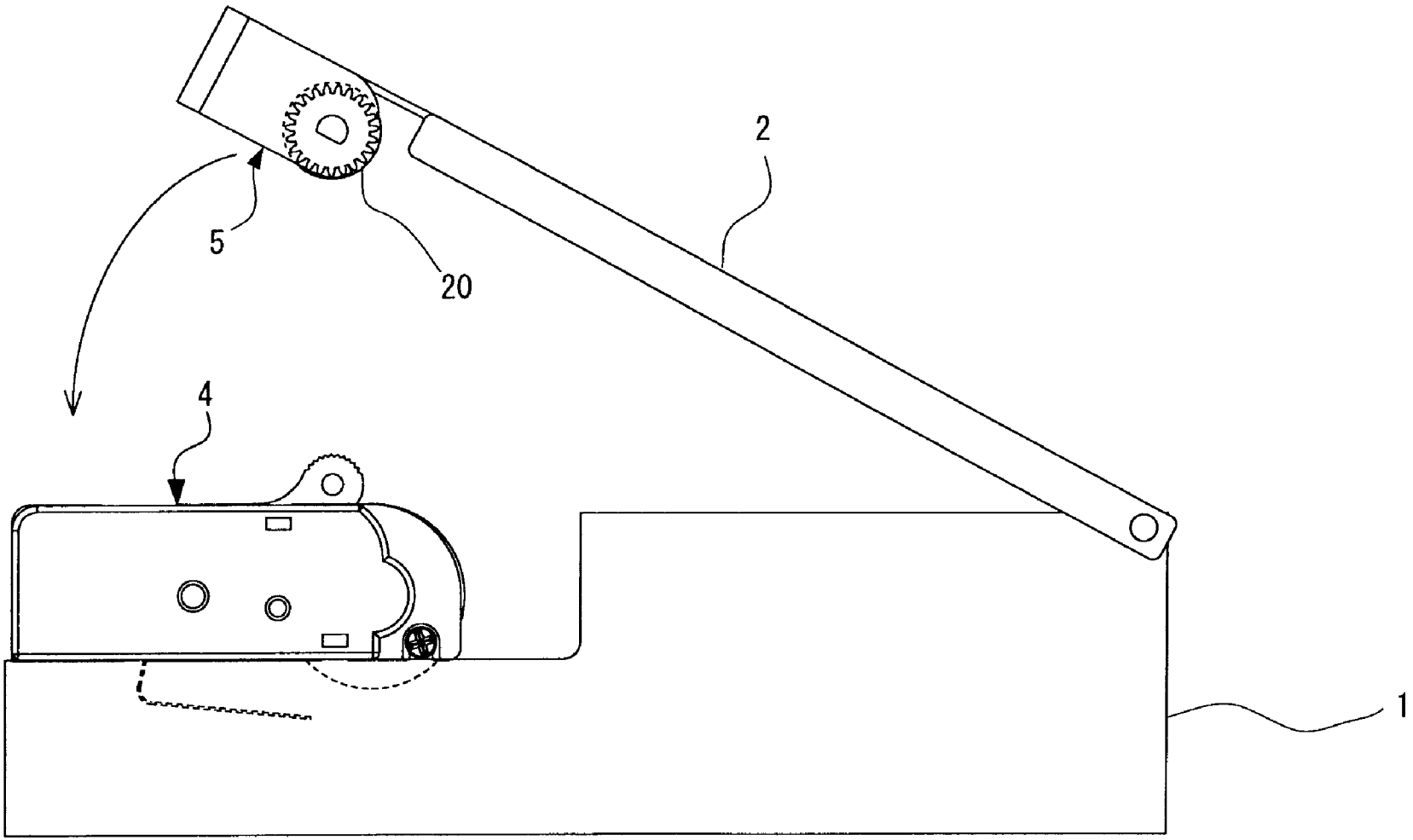
FIG. 1 is a diagram showing the overall construction of a printer according to an embodiment of the present invention.

FIG. 1 is a diagram showing the overall construction of the printer according to the embodiment.

The printer of this embodiment is configured so that the cover 2 is freely opened/closed with respect to the printer main body 1, a print head (not clearly shown in FIG. 1) is installed in the printer main body 1 and a platen 20 is installed in the cover 2. The platen 20 is freely detachably mounted in the printer main body 1 in connection with the opening/closing operation of the cover 2.

Figure 2:
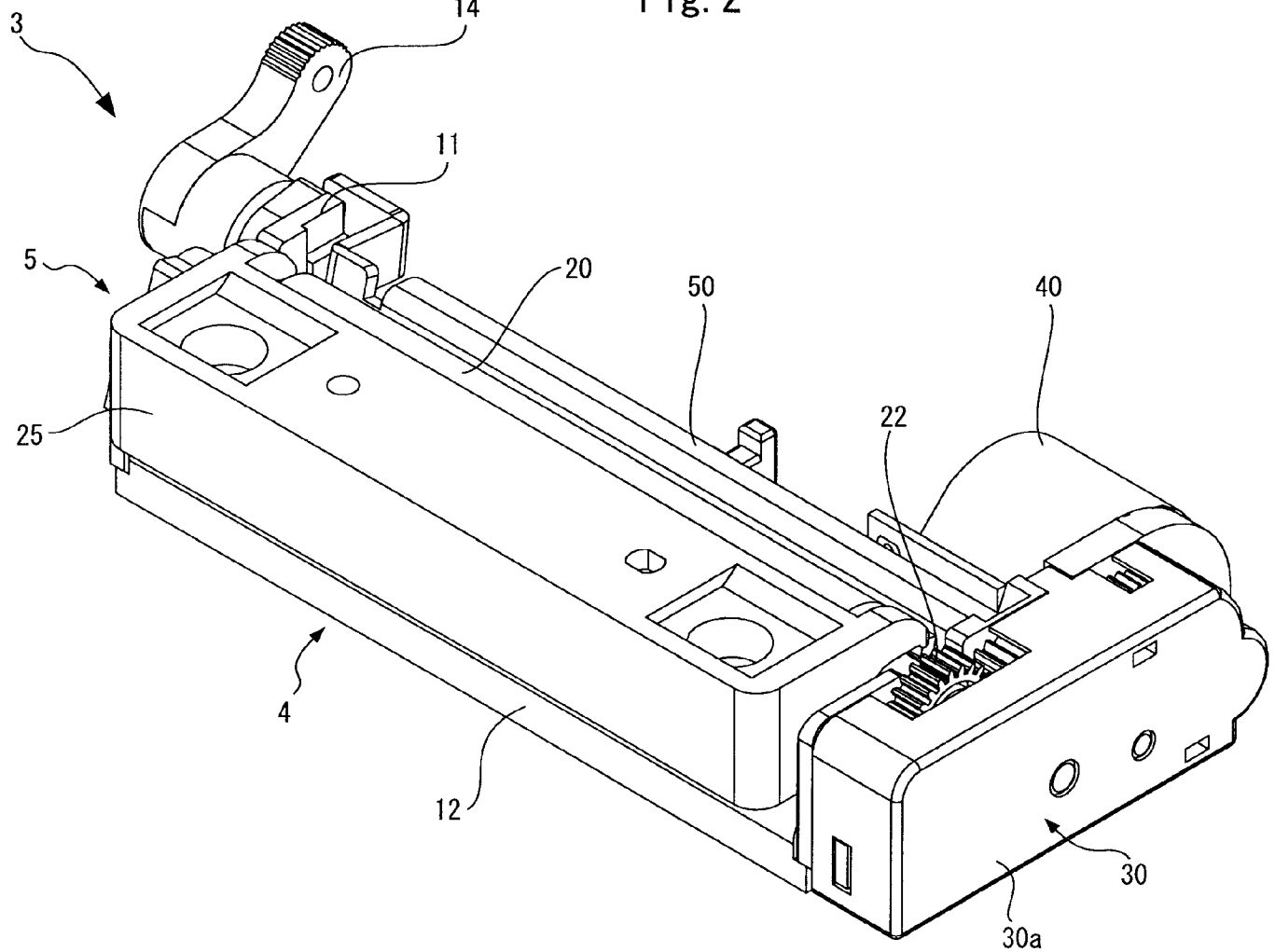
FIG. 2 is a perspective view showing a main part of the printer according to the embodiment.
Figure 3:
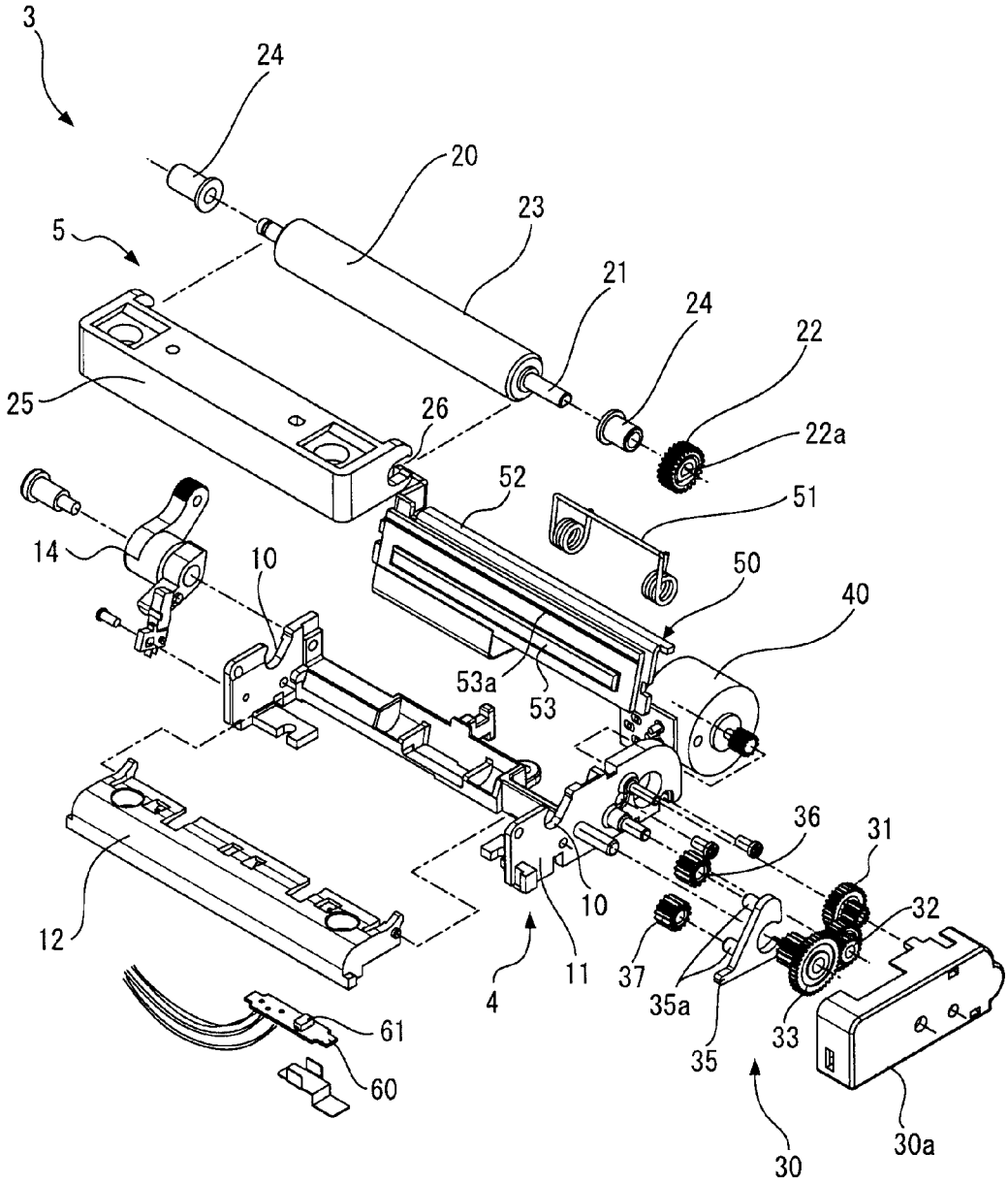
FIG. 3 is an exploded perspective view showing a main part of the printer according to the embodiment.
Figure 4A:
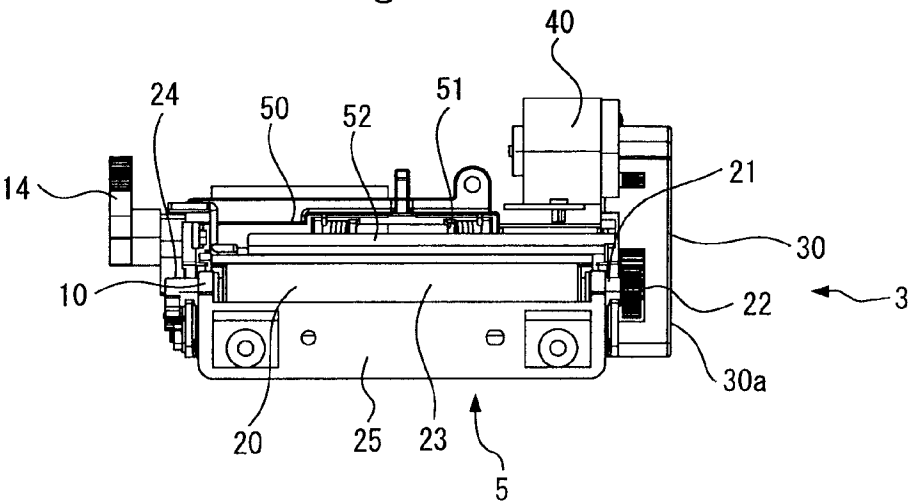
FIG. 4A is a top view.
Figure 4D:
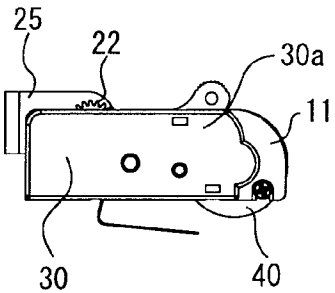
FIG. 4D is a right side view.
Figure 4B:
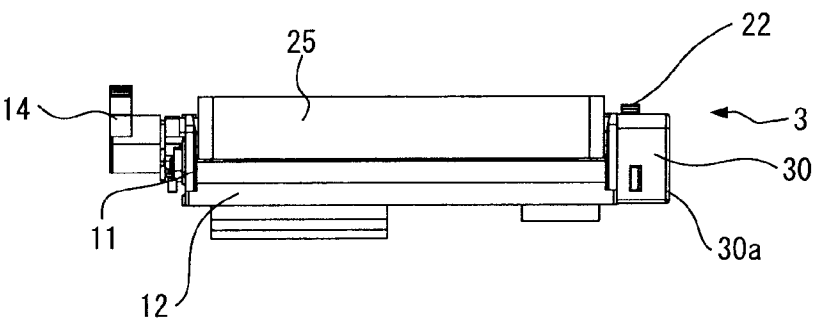
FIG. 4B is a front view.
Figure 4C:
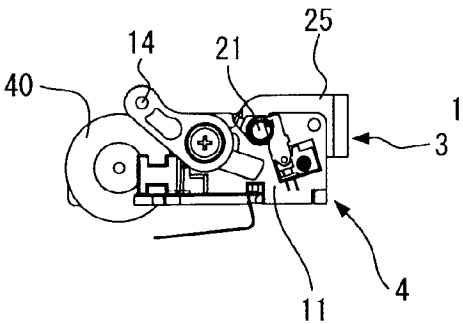
FIG. 4C is a left side view.

FIG. 2 is a perspective view showing a main part of the printer according to the embodiment, and FIG. 3 is an exploded perspective view of FIG. 2. FIG. 4 is a diagram showing a main part of the printer, FIG. 4A is a top view, FIG. 4B is a front view, FIG. 4C is a left side view and FIG. 4D is a right side view.

In the printer of this embodiment, a main part for performing print is constructed by a platen/print head unit 3 as shown in FIGS. 2 to 4. The platen/print head unit 3 is configured to contain a head unit 4 and a platen unit 5. A printer frame 11 which is formed of by die casting of zinc alloy material and a sheet guide member 12 formed of synthetic resin are assembled into the head unit 4 of the printer. A print head unit 50, a sheet sensor 60, a driving motor 40, a rotational driving mechanism 30, etc. are secured to the head unit 4.

Figure 6:
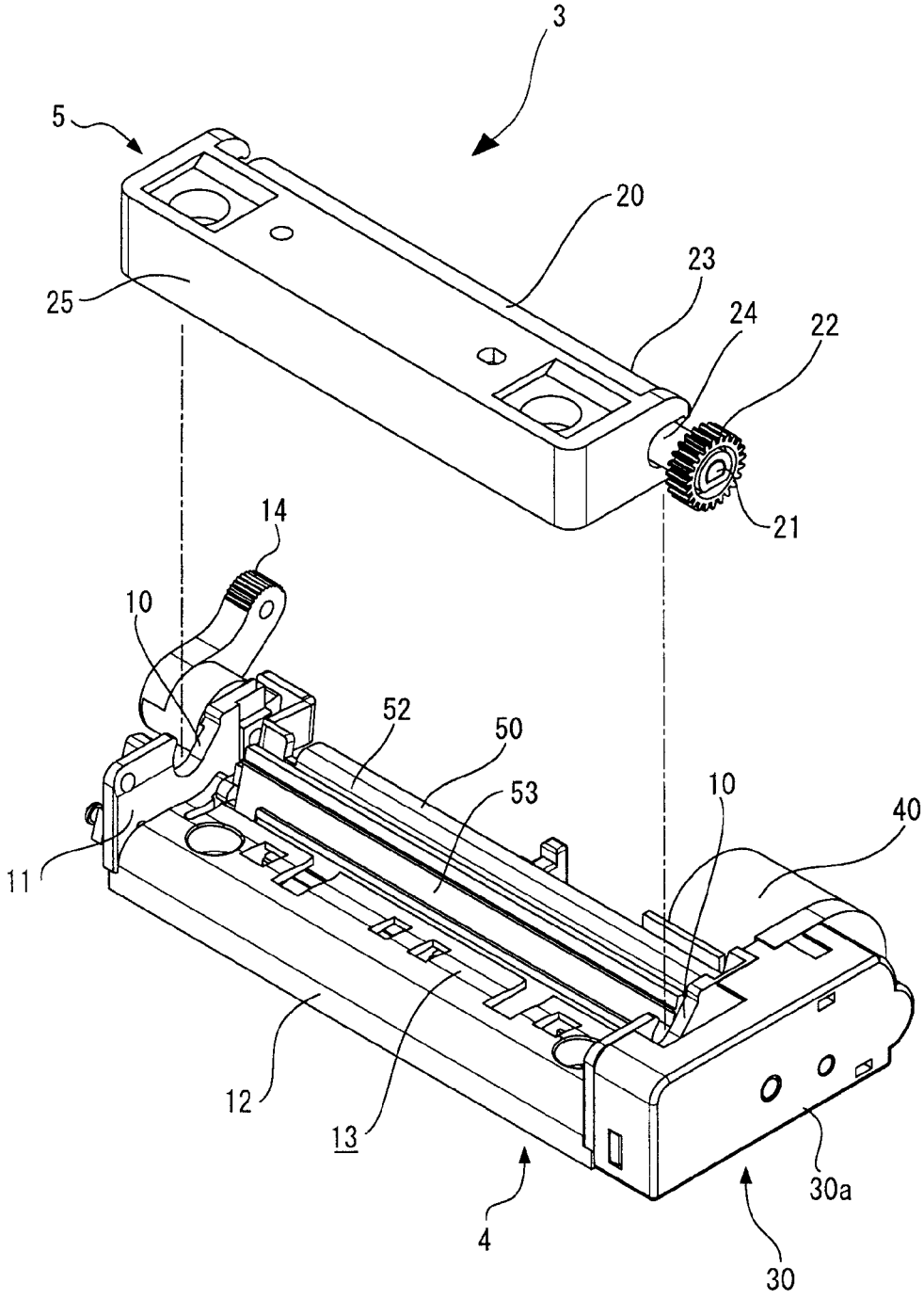
FIG. 6 is a perspective view showing assembling of a platen unit to a head holder of the printer according to the embodiment.

In the head unit 4, under the state that the printer frame 11 and the sheet guide member 12 are assembled, a space is formed at a corner portion of the upper surface of the head unit 4, and this space functions as a platen mount portion 13 in which the platen unit 5 is mounted (see FIG. 6). When the platen unit 5 is mounted in the platen mount portion 13, a print sheet of the printer is set so as to be sandwiched between the platen unit 5 and the platen mount portion 13. Accordingly, the gap between the head unit 4 and the platen unit 5 constitutes a print sheet feeding path, and the print sheet can be fed along with rotation of a platen 20 described later.

In the platen mount portion 13, the sheet guide member 12 is disposed at the lower side thereof, and a head holder 50 is secured to the sides perpendicular to the sheet guide member 12. Support grooves 10 are formed in both the side surfaces of the platen mount portion 13 so that the platen 20 is freely rotatably supported by the support grooves 10. A head operating lever 14 is rotatably secured to one side surface side of the platen mount portion 13, whereby the head holder 50 is switched between pressing to the platen 20 and separating from the platen 20.

The head holder 50 of the printer is secured so as to be freely swingable by a slight angle with an urging member 51. The head holder 50 is configured so that a print head 53 is mounted on a head support plate 52 formed of an iron plate member in the width direction thereof. The print head 53 is electrically connected through a wiring connector which is not shown and a heating element 53*a* on the upper surface of the print head 53 is heatable. The head holder 50 is operated by the head operating lever 14. Under a press state against the platen 20, the print head 53 is brought into contact with or made to approach to a set print sheet. On the other hand, under a separation state, the print head 53 is disposed at an evacuation position which is away from the print sheet.

Furthermore, the support groove 10 of the platen mount portion 13 is formed by notching a predetermined portion of the upper face of the printer frame 11. The support groove 10 is opened in conformity with an opening/closing orbit of the platen unit 5 in the paper drop-in type printer. Therefore, the support groove 10 is formed so that a notching direction is obliquely slanted with respect to the upper surface of the printer frame 11. Furthermore, an inner wall 10*a* is projected from the ceiling side of the support groove 10 (see FIG. 7B). The inner wall 10*a* can effectively prevent an upward swing motion of the platen 20.

Furthermore, the sheet sensor 60 of the printer is secured so that a sensor portion 61 is exposed from the lower surface of the sheet guide member 12. The sheet sensor 60 has a function of detecting a print sheet set on the platen mount portion 13 by the sensor portion 61, and the presence or absence of a print sheet can be determined when the print sheet is exchanged or the like.

Figure 5B:
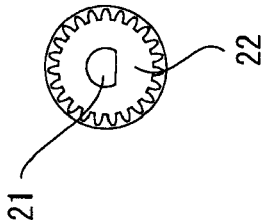
FIG. 5B is a side view.
Figure 5A:
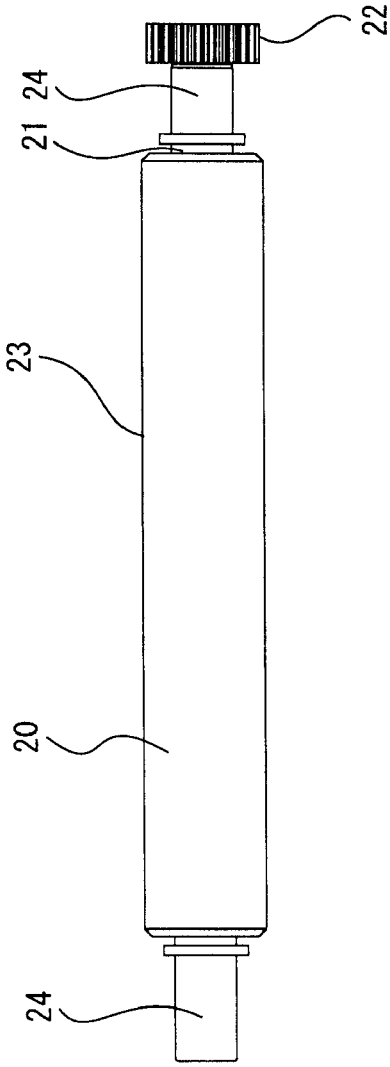
FIG. 5A is a top view.

FIG. 5 is a diagram showing the construction of the platen of the printer according to the embodiment, wherein FIG. 5A is a top view and FIG. 5B is a side view.

As shown in FIGS. 2 to 5, the platen unit 5 is fabricated by the platen 20 and the platen holder 25. The platen 20 has a rotational shaft 21 formed of a rigid metal material, and an elastic member 23 such as a synthetic rubber is engagedly fitted around the outer periphery of the rotational shaft 21. Bearings 24 formed of synthetic resin are secured to both the end portions of the rotational shaft 21. A part of the shaft at one end portion of the rotational shaft 21 is cut out, and an insertion hole 22*a* of the platen-side gear 22 is fitted to this cut-out, whereby the platen-side gear 22 is fixed to the one end portion of the rotational shaft 21 of the platen 20.

The platen holder 25 is a frame which is formed in conformity with the length of the elastic member 23 of the platen 20 to support the platen. A pair of C-shaped opening portions 26 are formed at both the end portions of the platen holder 25. The bearings 24 of the platen 20 are inserted into the opening portions 26 when the platen unit 5 is fabricated. Under the fabrication state of the platen unit 5, the platen 20 is freely rotatably supported through the opening portions 26, and also the platen-side gear 22 and the bearings 24 are projected from the side surface side of the platen holder 25.

FIG. 6 is a perspective view showing the assembling of the platen unit to the head holder of the printer according to the embodiment.

When the platen unit 5 is assembled to the head unit 4 of the printer, the platen unit 5 is inserted into the platen mount portion 13 of the head unit 4 as shown in FIG. 6. When the platen unit 5 is inserted, the facing head holder 50 is moved outwardly. However, the urging member 51 acts on the head holder 50 so that the head holder 50 elastically returns. As a result, the head holder 50 presses the inserted platen 20, and thus the platen unit 5 can be assembled to the platen mount portion 13. Accordingly, the platen 20 is disposed so as to be orthogonal to the feeding direction of the print sheet.

At the assembling time, the bearings 24 of the platen 20 projecting from the side surface sides of the platen holder 25 are inserted into the support grooves 10 opened to both the side surfaces of the platen mount unit 13, whereby the rotational shaft 21 of the platen 20 is freely rotatably supported by the support grooves 10 of the head unit 4 and the opening portions 26 of the platen holder 25. At this time, the platen-side gear 22 located at the outside of the bearing 24 is inserted in the rotational driving mechanism 30 provided to the side surface side of the platen mount unit 13.

Figure 7B:
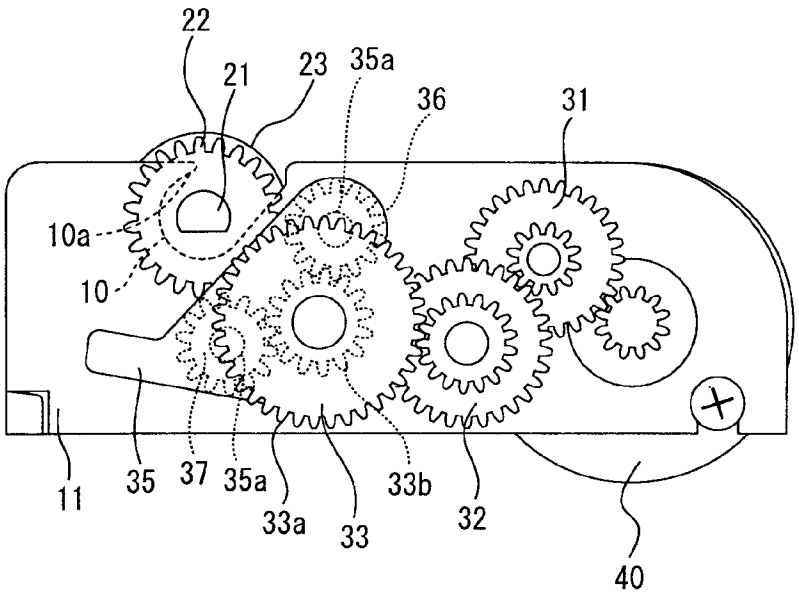
FIG. 7A is a top view and FIG. 7B is an enlarged side view.
Figure 7A:
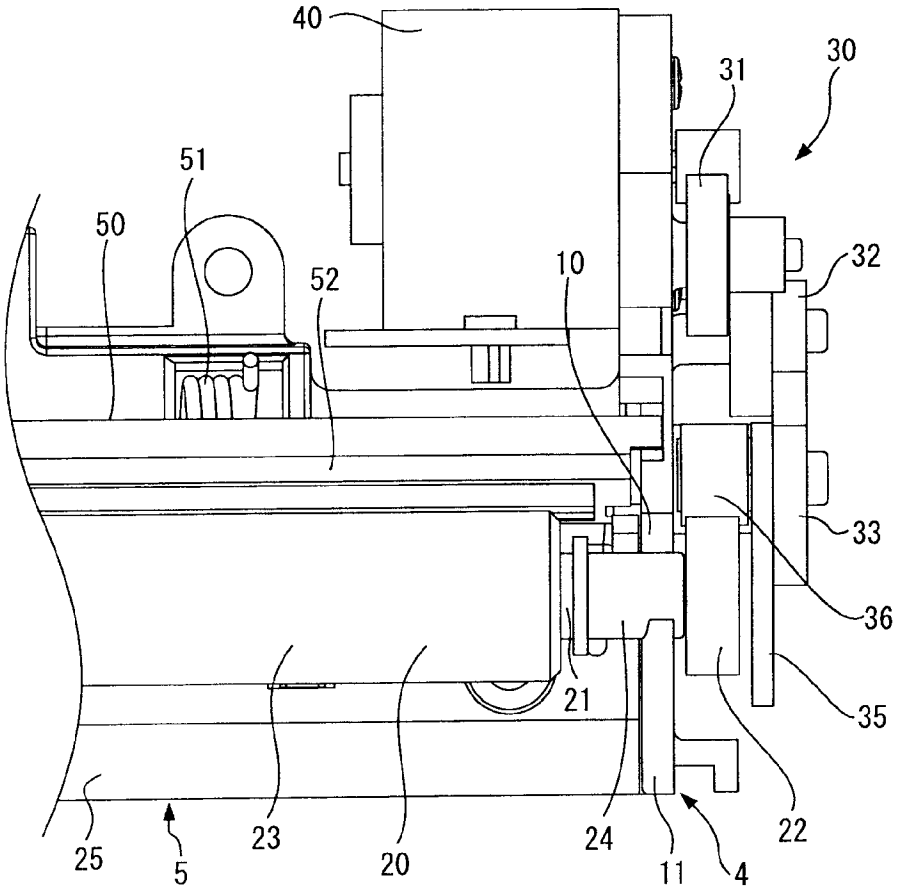

FIG. 7 shows the driving motor of the printer and the rotational driving mechanism according to this embodiment, wherein FIG. 7A is a top view and FIG. 72 is an enlarged side view.

As shown in FIGS. 7A and 7B, the driving motor 40 of the printer and the rotational driving mechanism 30 are secured at a side surface side opposite to the side surface side at which the head operating lever 14 of the head unit 4 is provided. The driving motor 40 of the printer is connected to an external controller (not shown). With respect to the driving motor 40 of this embodiment, the speed of the rotational driving of the driving motor 40 is controlled while the rotational angle of the motor is proportional to an input pulse signal transmitted from the controller. Furthermore, the driving motor 40 is configured to rotate forwardly and reversely in response to a signal from the controller.

On the other hand, the rotational driving mechanism 30 is provided with plural gears (three in this embodiment) 31, 32, 33 for transmitting the rotational driving force of the driving motor 40 in the case 30*a* (see FIG. 3). Two-stage gears comprising a large-diameter gear and a small-diameter gear having different numbers of teeth are used for each of the gears 31, 32, 33. The large-diameter gear and the small-diameter gear are engaged with each other among the different gears 31, 32 and 33, whereby these gears 31, 32, 33 are joined in sequence. Accordingly, the rotational driving of the driving motor 40 is appropriately decelerated while successively transmitted to the gear at the downstream side in the rotational driving mechanism 30.

Furthermore, with respect to the gear 33 at the end side of the rotational driving mechanism 30, a change-over plate 35 is freely rotatably secured between a large-diameter gear 33*a* and a small-diameter gear 33*b* constituting the two-stage gear structure. The change-over plate 35 is formed of a plate-shaped member having a substantially triangular shape, and cylindrical portions 35*a* projecting to the small-diameter gear 33*b* are provided in the neighborhood of the two apex portions of the change-over plate 35. First and second planetary gears 36 and 37 are secured to the respective cylindrical portions 35*a*. The small-diameter gear 33*b* of the gear 33 at the end side is configured to be engaged with the first and second planetary gears 36 and 37. Accordingly, the gear 33 at the end side functions as a sun gear for the two planetary gears.

The first and second plane gears 36 and 37 are configured to be individually engaged with the platen-side gear 22 of the platen 20 which is inserted in the support groove 10 when the change-over plate is driven in accordance the rotational direction of the gear 33 at the end side. That is, the first planetary gear 36 is engaged with the plate-side gear 22 to transmit the rotational driving force from the gear 33 at the end side when a print sheet is fed in the forward direction, and the second planetary gear 37 is engaged with the platen-side gear 22 to transmit the rotational driving force from the gear 33 at the end side when a print sheet is fed in the reverse direction.

Accordingly, the rotational driving mechanism 30 transmits the rotational driving force of the driving motor 40 to the platen-side gear 22, so that the platen 20 supported through the shaft in the support grooves 10 can be rotated. Here, the respective planetary gears 36 and 37 are formed of gears having the same number of gear teeth, and thus the respective planetary gears 36 and 37 transmit the rotational driving force to the platen-side gear 22 at the same speed ratio.

[Action when Print Sheet is Forwardly Fed]

Figure 8B:
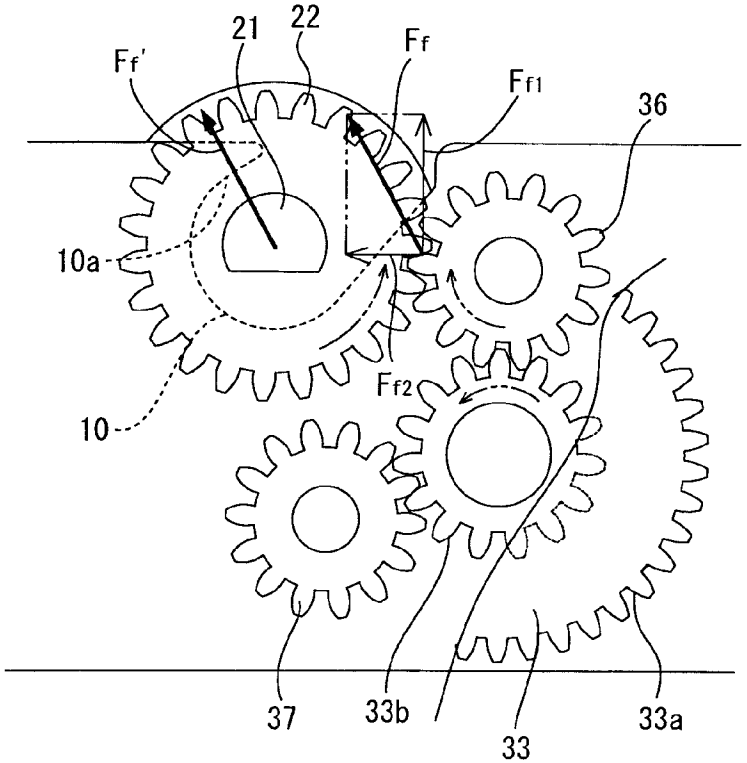
FIG. 8A is a side view and FIG. 8B is an enlarged side view showing the neighborhood of a platen-side gear.
Figure 8A:
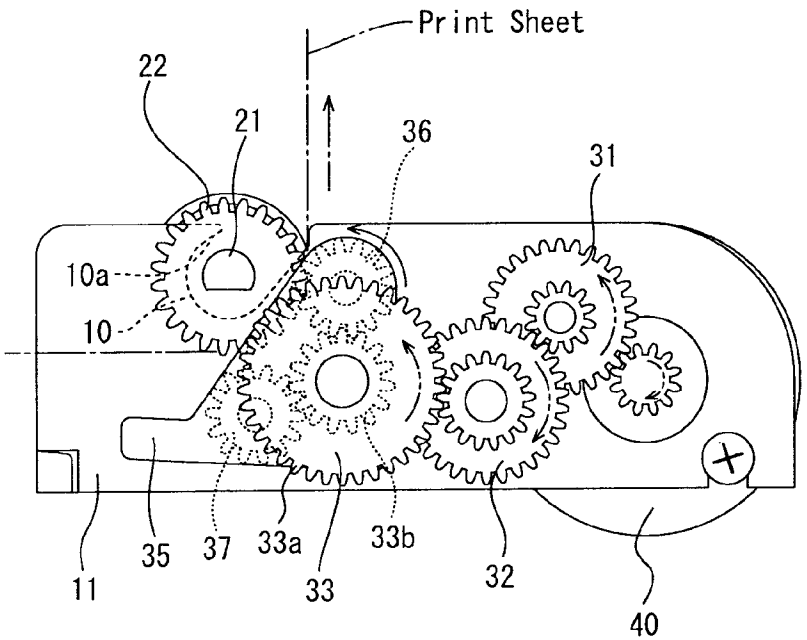

FIG. 8 shows the operation of the rotational driving mechanism when the print sheet is fed in the forward direction in the printer according to this embodiment, wherein FIG. 8A is a side view and FIG. 8B is an enlarged side view of the neighborhood of the platen-side gear.

As shown in FIG. 8A, when the print sheet is fed in the forward direction in the printer of this embodiment, the controller rotates the driving motor 40 forwardly (clockwise). This rotational driving force is transmitted to the gear 33 at the end side through the respective gears 31 and 32 of the rotational driving mechanism 30, and the gear 33 at the end side is rotated counterclockwise.

At this time, the change-over plate 35 secured to the gear 33 at the end side revolves counterclockwise according to the counterclockwise rotation of the gear 33. When the first planetary gear 36 is engaged with the platen-side gear 22, the revolution of the change-over plate 35 is stopped, and the counterclockwise rotation of the small-diameter gear 33*b* of the gear 33 is transmitted to the first planetary gear 36. The rotation-transmitted first planetary gear 36 is rotated clockwise, so that the first planetary gear 36 rotates the engaged platen-side gear 22 counterclockwise. The rotation of the platen-side gear 22 causes the platen 20 to rotate, and a print sheet sandwiched between the head unit 4 and the platen unit 5 is fed out in the forward direction (in the upward direction in FIG. 8A).

Here, the first planetary gear 36 is engaged at such a position as to prevent the platen 20 from being uplifted toward the opening of the support groove 10. Accordingly, the bearings 24 mounted at both the end portions of the rotational shaft 21 are prevented from being uplifted from the bottom portions of the support grooves 10, so that the platen 20 can be rotated stably and het print sheet can be surely supported by the platen 20.

Furthermore, as shown in FIG. 8B, at the engagement position between the first planetary gear 36 and the platen-side gear 22, push-out force Ff1 caused by rotation acts tangentially, and also revolution force Ff2 applied from the gear 33 at the end side acts in the normal line direction. Accordingly, at the engagement position, the combination force Ff of the two forces Ff1 and Ff2 acts in an obliquely upward direction, and force Ff' also acts on the rotational shaft 21 of the platen 20 in the same direction. Here, an inner wall 10*a* of the support groove 10 exists in the acting direction of the force Ff' in the support groove 10 of this embodiment. Accordingly, the inner wall 10*a* receives the force Ff', and thus prevents the rotational shaft 21 of the platen 20 from being uplifted and consequently being pushed out from the support groove 10.

[Action when Print Sheet is Reversely Fed]

Figure 9B:
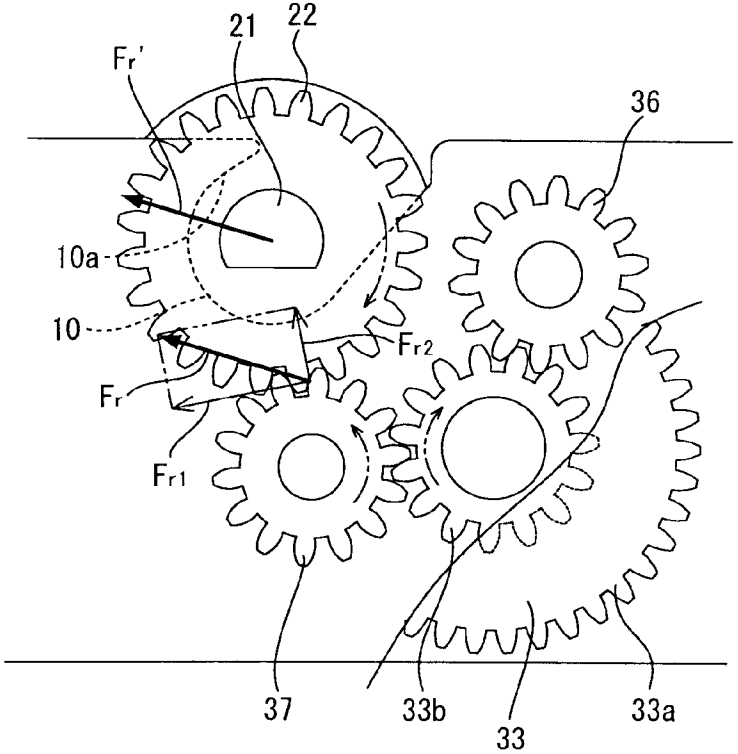
FIG. 9A is a side view and FIG. 9B is an enlarged view showing the neighborhood of the platen-side gear.
Figure 9A:
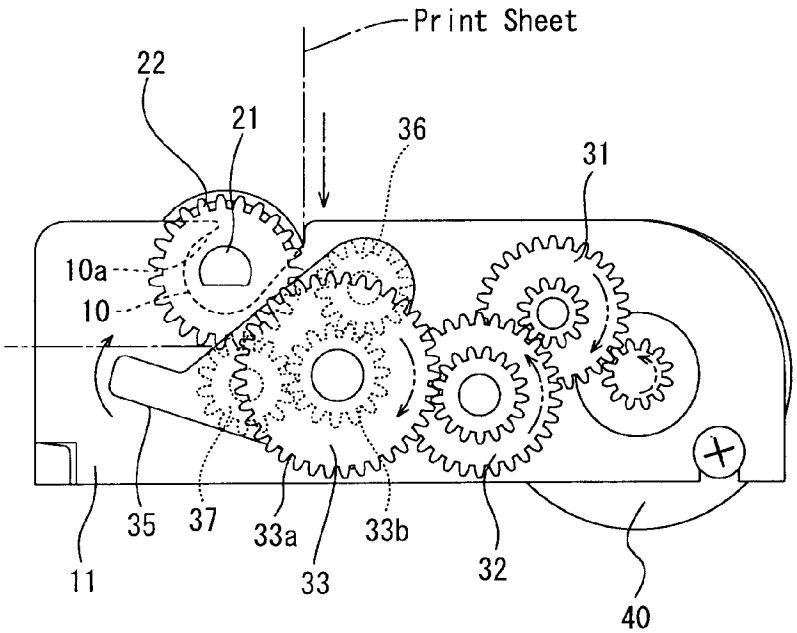

FIG. 9 is a diagram showing the operation of the rotational driving mechanism when the print sheet is fed in the reverse direction in the printer according to this embodiment, wherein FIG. 9A is a side view and FIG. 9B is an enlarged side view of the neighborhood of the platen-side gear.

As shown in FIG. 9A, when the print sheet is reversely fed in the printer of this embodiment, the controller rotates the driving motor 40 reversely (counterclockwise). This rotational driving force is transmitted to the gear 33 at the end side through the respective gears 31 and 32 of the rotational driving mechanism 30, and the gear 33 at the end side is rotated clockwise.

At this time, the change-over plate 35 secured to the gear 33 at the end side revolves clockwise according to the clockwise rotation of the gear 33. The second planetary gear 37 is engaged with the platen-side gear 22, and the resolution of the change-over plate 35 is stopped, so that the clockwise rotation of the small-diameter gear 33*b* of the gear 33 is transmitted to the second planetary gear 37. The rotation-transmitted second plane gear 37 is rotated counterclockwise, so that the second planetary gear 37 rotates the engaged platen-side gear 22 clockwise. This rotation of the platen-side gear 22 causes the platen 20 to rotate, so that the print sheet sandwiched between the head unit 4 and the platen unit 5 is fed out in the reverse direction (to the left side in FIG. 9A).

Furthermore, at the engagement position between the second planetary gear 37 and the platen-side gear 22, as shown in FIG. 9B, push-out force Fr1 caused by rotation acts tangentially, and revolution force Fr2 applied from the gear 33 at the end side acts in the normal line direction. Accordingly, at the engagement position, the combination force Fr of the two forces acts in an obliquely upward direction, and force Fr' also acts on the rotational shaft 21 of the platen 20 in the same direction. Here, this force Fr' directs to the bottom portion of the support groove 10, and thus it acts as push-in force of pushing the rotational shaft 21 into the bottom portion of the support groove 10. Accordingly, the bearing 24 mounted on the rotational shaft 21 of the platen 20 is not uplifted from the support groove 10, so that the platen 20 can be stably rotated and the print sheet can be surely supported by the platen 20.

[Action when Platen Unit is Detached]

Figure 10B:
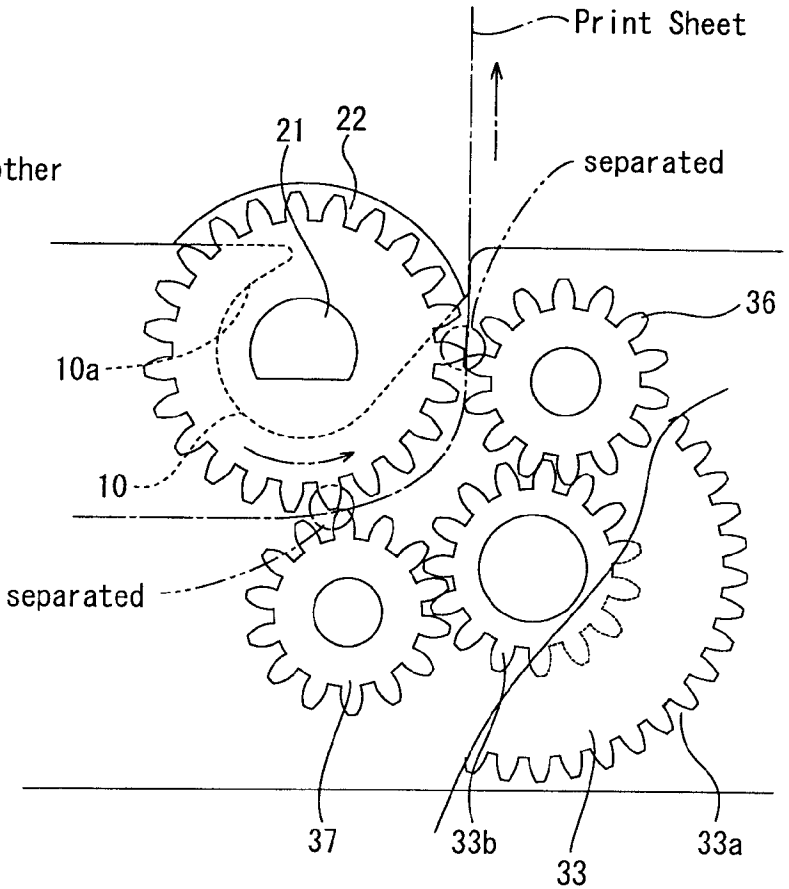
FIG. 10B is an enlarged side view when the print sheet is pulled.
Figure 10A:
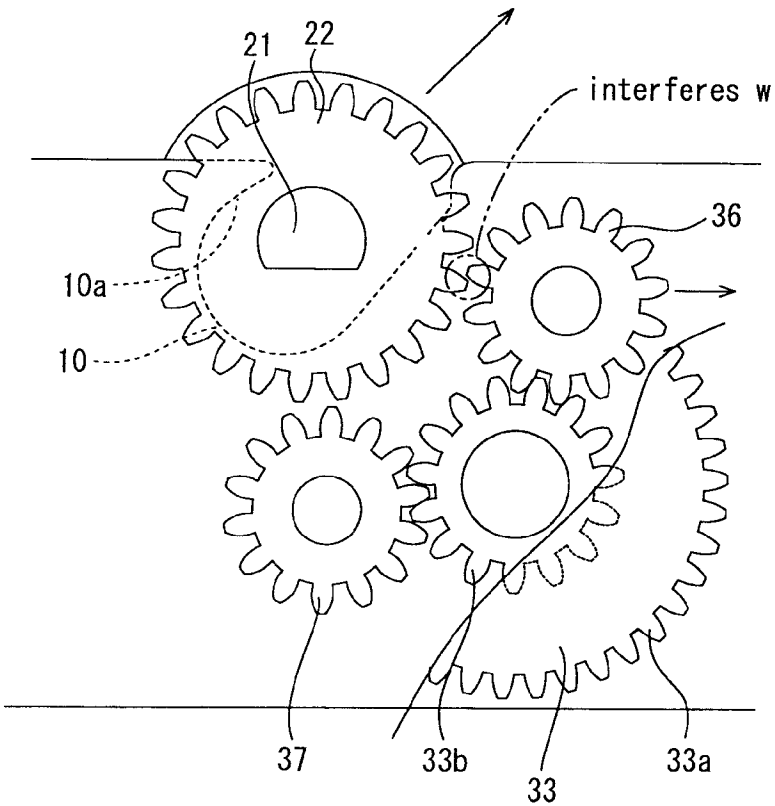
FIG. 10A is an enlarged side view when the platen is detached.

FIG. 10 is an enlarged side view showing another action of the planetary gear in the printer of this embodiment, wherein FIG. 10A is a view when the platen is detached and FIG. 10B is a view when the print sheet is pulled.

In the printer according to this embodiment, as shown in FIG. 10A, when the rotational shaft 21 of the platen 20 is detached from the support groove 10, the platen-side gear 22 and the first planetary gear 36 interferes with each other, and the change-over plate 35 moves to the right side. The movement of the change-over plate 35 enables the first planetary gear 36 of the rotational driving mechanism 30 to move into the rotational driving mechanism (to the right side). Accordingly, the first planetary gear 36 does not exist in the release direction of the platen-side gear 22, so that the rotational shaft 21 of the platen 20 can be easily taken out from the support groove 10.

[Action Under Paper Jam]

As shown in FIG. 10B, when a print sheet is pulled out in maintenance for paper jam or the like, the platen-side gear 22 is rotated, and this rotational force is transmitted to the change-over plate 35 through the first and second planetary gears 36 and 37, so that the change-over plate 35 is easily moved. Therefore, the first and second planetary gears 36 and 37 are separated from the platen-side gear 22, and thus the engagement thereof with the platen-side gear 22 is released. Accordingly, a large load is prevented from being applied to the respective teeth of the platen-side gear 22 and the first and second planetary gears 36 and 37, so that the respective gears can be prevented from being damaged or the like.

According to the printer of this embodiment, even when the platen 20 is rotated in any direction of the forward and reverse directions, the bearings 24 mounted on the rotational shaft 21 of the platen 20 can be prevented from being uplifted from the support grooves 10, so that the stable rotation of the platen 20 and the secure supporting of the print sheet by the platen 20 can be implemented.

Furthermore, according to this embodiment, the rotational direction of the planetary gears 36 and 37 and the engagement position with the platen-side gear 22 are set so that the all the gears 31, 32, 33, 36, 37 constituting the rotational driving mechanism 30 can be disposed at one side (at the right side in FIG. 7B) with respect to the platen-side gear 22. Therefore, the overall structure of the printer can be miniaturized.

The present invention is not limited to the above embodiment. For example, the print head can be directly installed into the printer main body and the platen is directly installed in the cover without constructing the main part by the platen/print head unit.

The invention claimed is:

1. A printer comprising:

a print head;

a platen having one end to which a platen-side gear is secured;

a driving motor;

a rotational driving mechanism for transmitting the rotational driving force of the driving motor to the platen-side gear; and a printer frame having a support groove having an opening through which the platen is inserted/detached, wherein the rotational driving mechanism contains a sun gear, and a pair of planetary gears that move around the sun gear while engaged with the sun gear and are engaged with a platen-side gear, and the support groove, the platen-side gear and the rotational driving mechanism are arranged so that when one of the planetary gears is engaged with the platen-side gear, the planetary gear concerned is engaged with the platen-side gear at such a position as to prevent the platen supported in the support groove from moving toward the opening of the support groove, and when the other planetary gear is engaged with the platen-side gear, the rotational driving force to be transmitted to the platen-side gear acts on the platen-side gear so as to prevent the platen supported in the support groove from moving toward the opening of the support groove.

2. The printer according to claim 1, wherein the engagement between the platen-side gear and each of the paired planetary gears is released when the platen is inserted/detached into/from the support groove.

3. The printer according to claim 2, wherein the pair of planetary gears are constructed by gears having the same number of gear teeth.

4. The printer according to any one of claims 1 to 3, further comprising a printer main body for holding the printer frame and a cover that holds the platen and is supported by the printer main body so as to be openable and closable.

* * * * *